US006375052B2

(12) United States Patent
Keton

(10) Patent No.: US 6,375,052 B2
(45) Date of Patent: Apr. 23, 2002

(54) WEAPON HOLDING STRAPS FOR A HUNTER'S LAP

(76) Inventor: Fred B. Keton, P.O. Box 215, Swifton, AR (US) 72471

( * ) Notice: Subject to any disclaimer, the term of this patent is extended or adjusted under 35 U.S.C. 154(b) by 0 days.

(21) Appl. No.: 09/759,471

(22) Filed: Jan. 16, 2001

Related U.S. Application Data

(60) Provisional application No. 60/189,055, filed on Mar. 14, 2000.

(51) Int. Cl.[7] ..... A45F 3/14

(52) U.S. Cl. ..... 224/222; 224/250; 224/913; 42/94

(58) Field of Search ..... 224/222, 250, 224/913; 42/94

(56) References Cited

U.S. PATENT DOCUMENTS

| | | | | |
|---|---|---|---|---|
| 4,709,693 A | * | 12/1987 | Key | 128/94 X |
| 4,759,963 A | * | 7/1988 | Uso, Jr. et al. | 428/100 |
| 4,819,844 A | | 4/1989 | Niemela | |
| 4,863,083 A | * | 9/1989 | Chen | 224/226 |
| 5,450,991 A | * | 9/1995 | Neading | 224/151 |
| 5,535,928 A | * | 7/1996 | Herring | 224/250 |
| 5,642,847 A | | 7/1997 | DeMeo et al. | |
| 5,669,170 A | | 9/1997 | Norris | |
| 5,718,363 A | * | 2/1998 | Graves | 224/250 |
| 5,850,955 A | | 12/1998 | Barr | |
| 5,881,487 A | | 3/1999 | Chalker | |
| 5,927,574 A | | 7/1999 | Ruesink | |
| 6,176,403 B1 | * | 1/2001 | Svare et al. | 224/251 |
| 6,266,910 B1 | * | 7/2001 | Horine | 42/94 |

FOREIGN PATENT DOCUMENTS

| | | |
|---|---|---|
| FR | 2577123 | 8/1986 |

* cited by examiner

*Primary Examiner*—Stephen K. Cronin
(74) *Attorney, Agent, or Firm*—Richard C. Litman

(57) ABSTRACT

The weapon holding straps are a pair of nylon straps adapted for holding and readily releasing a firearm or bow across a hunter's lap while sitting on the ground or in a tree. Each nylon strap is formed from a leg strap and a weapon retainer strap of nylon webbing material attached together in cruciform fashion. The ends of each nylon strap have hook and loop material attached thereto. The leg strap is wrapped around the hunter's leg, the weapon retainer strap is wrapped around the firearm or bow. One strap is placed around the right leg and the other strap is placed around the left leg, the straps securing opposite ends of the firearm or bow, leaving the hunter's hands free while keeping the weapon readily accessible.

13 Claims, 4 Drawing Sheets

WEAPON HOLDING STRAPS FOR A HUNTER'S LAP

CROSS-REFERENCE TO RELATED APPLICATION

This application claims the benefit of U.S. Provisional Patent Application Ser. No. 60/189,055, filed Mar. 14, 2000.

BACKGROUND OF THE INVENTION

1. Field of the Invention

The present invention relates generally to weapon holders. More specifically, the invention is a pair of nylon straps adapted for holding a firearm or bow across a hunter's lap.

2. Description of Related Art

The related art of interest describes various weapon holders, but none discloses the present invention. Some hunters use ladder stands, climbing stands, and even boom stands while hunting game. When using such stands, the hunter sits with his knees lower than his hips. The hunter tends to rest his firearm on his lap while waiting for the game to appear. Since his knees are lower than his hips, the firearm tends to slide off his lap, and so the hunter tends to hold the firearm with his forearm, which is fatiguing. If the hunter has a long wait, the hunter may fall asleep, and the gun falls off his lap. Therefore, both for reasons of safety and convenience, there is a need for a device which permits hunters to be able to temporarily hold their weapons across their laps safely while sitting on the ground or up in a tree, but also permits ready access to their weapons when game appears. The related art will be discussed in the order of perceived relevance to the present invention.

U.S. Pat. No. 5,642,847, issued on Jul. 1, 1997 to DeMeo et al., describes a firearm support comprising a chest harness for a rifle having an intricate base assembly with support pins and a strap for attaching the rifle to the base assembly. Two shoulder straps, a chest strap and two waist straps are also attached to the base assembly. The firearm support apparatus is distinguishable for its unique structure and the requirement for attaching the rifle to the hunter's chest.

U.S. Pat. No. 5,850,955, issued on Dec. 22, 1998 to Thomas D. Barr, describes a bow holder apparatus comprising an open pouch with two extensions on top strapped to one of the archer's upper legs and a J-hook projection on the pouch's bottom engaging the shoe. The pouch collapses when the archer stands. The bow holder apparatus is distinguishable for its distinct pouch structure.

U.S. Pat. No. 5,718,363, issued on Feb. 17, 1998 to Gordon Graves, describes a firearm carrier comprising a quick release buckled waist strap from which two straps with hook and loop fasteners suspend. The carrier can also be used as a shoulder sling. The firearm carrier is distinguishable for its limitation to attach to a hunter's waist or to be carried slung around the shoulder.

U.S. Pat. No. 4,819,844, issued on Apr. 11, 1989 to Pekka Niemela, describes a carrying strap for carrying a shotgun in front of the chest and ready to shoot. The carrying strap is attached to the barrel by a wire extension and pin. The opposite end of the strap is attached to the stock by a similar wire extension attached across the butt end. The carrying strap is distinguishable for its sling positioned across the hunter's back.

U.S. Pat. No. 5,669,170, issued on Sep. 23, 1997 to Terry B. Norris, describes a sling for carrying a long gun upright in front of the chest. A buckled waist belt and an optional chest belt has a vertical shoulder strap with a pair of crossed hook and loop fasteners for securing the gun. The sling is distinguishable for its multiple chest straps.

U.S. Pat. No. 5,881,487, issued on Mar. 16, 1999 to Dennis Chalker describes a sling for carrying a weapon on a hooked strap suspended from a padded shoulder harness. The sling is distinguishable for its shoulder harness.

U.S. Pat. No. 5,927,574, issued on Jul. 27, 1999 to Darrell H. Ruesink, describes a rifle and shotgun harness comprising a shoulder strap with an auxiliary strap attached to a waist belt and a pouch for retaining the butt of the weapon. The weapon can be carried in front or in back of the hunter. The gun harness is distinguishable for its shoulder strap, auxiliary strap, waist belt and the pouch.

French Patent Application No. 2,577,123, published on Aug. 14, 1986, describes a length-adjustable strap for carrying skis and ski sticks on one's back vertically. The shoulder strap has two adjustable holding rings with fasteners. The bottom ring is adjustable in height. The shoulder strap is locked in front with male-female fasteners. The ski carrying strap is distinguishable for its limitation to a shoulder strap for carrying lengthy materials on one's back.

None of the above inventions and patents, taken either singly or in combination, is seen to describe the instant invention as claimed.

SUMMARY OF THE INVENTION

The present invention is a pair of nylon straps adapted for holding and readily releasing a firearm or bow across a hunter's lap while sitting on the ground or in a tree. Each nylon strap is formed from a leg strap and a weapon retainer strap of nylon webbing material attached together in cruciform fashion. The ends of each nylon strap have hook and loop material attached thereto. The leg strap is wrapped around the hunter's leg, the weapon retainer strap is wrapped around the firearm or bow. One strap is placed around the right leg and the other strap is placed around the left leg, the straps securing opposite ends of the firearm or bow, leaving the hunter's hands free while keeping the weapon readily accessible.

Accordingly, it is a principal object of the invention to provide a weapons holder for a hunter sitting on the ground or in a tree.

It is another object of the invention to provide a weapons holder for a hunter's lap which keeps a firearm or bow secured to the hunter's lap while sitting on the ground or in a tree.

It is a further object of the invention to provide a weapons holder on a hunter's lap by readily releasable straps on the hunter's legs.

Still another object of the invention is to provide a holder for retaining a rifle, shotgun or bow on the hunter's lap in order to relieve the necessity of retaining the weapon in readiness on the hunter's lap by hand for extended periods of time.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
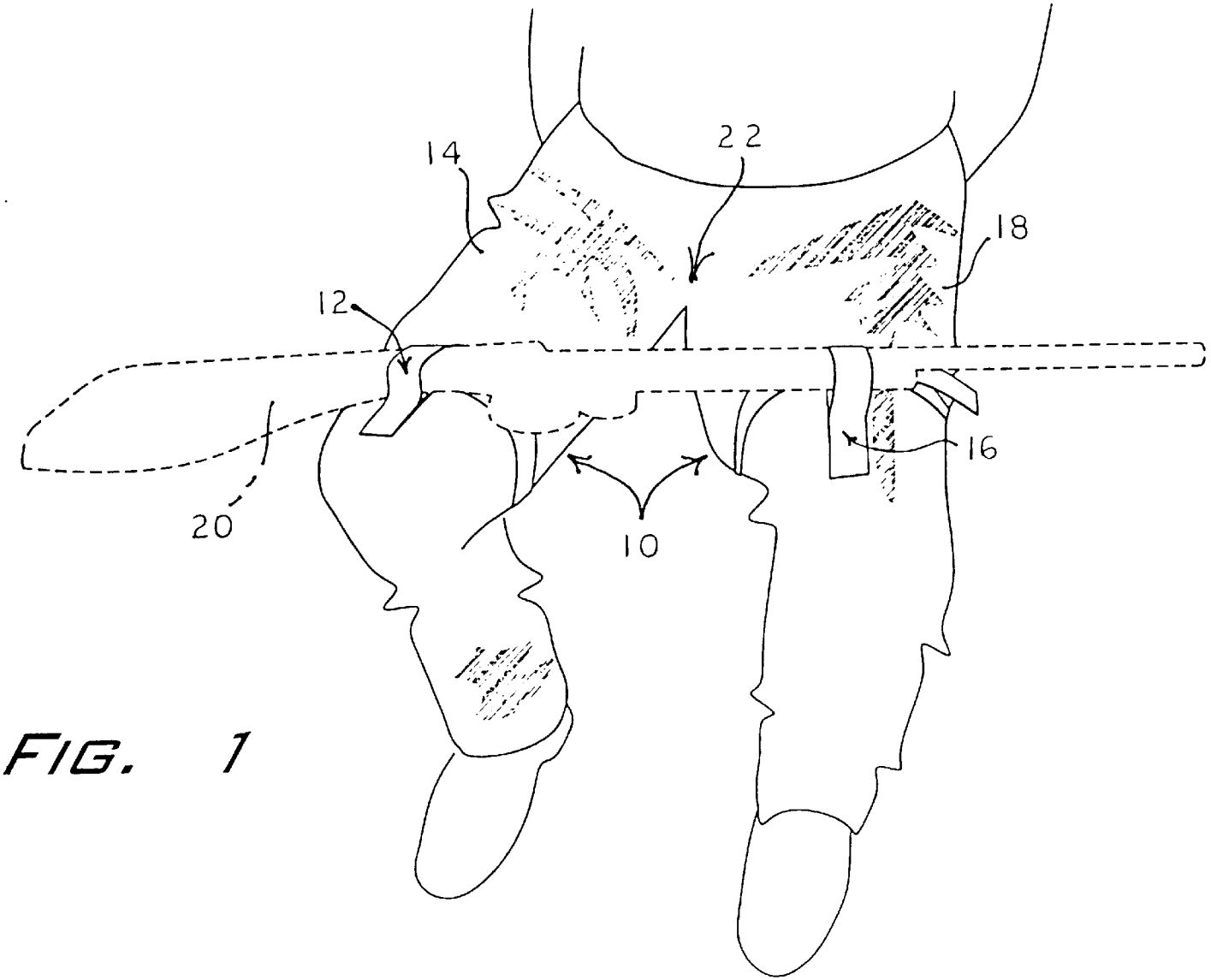
FIG. 1 is an environmental, front perspective view of a hunter holding his weapon, e.g., rifle or shotgun shown in shadow, on his lap by the weapon holding straps according to the present invention.

The present invention is illustrated in FIGS. 1 to 4 as a pair of weapon holding straps for a hunter's lap, the device 10 including a right leg holding strap 12 for the hunter's right leg 14 and a left leg holding strap 16 for the left leg 18 to temporarily maintain a weapon 20 (shown in shadow as a rifle or shotgun, although the device 10 may also be used to hold a bow) on the lap 22 while the hunter is sitting on the ground or in a tree. While waiting for game to approach, the hunter must maintain the weapon, e.g., rifle, shotgun or a hunting bow, in readiness on the lap 22 to rest the arms, as it can be fatiguing to hold the weapon 20 in one's hands for a long time waiting for game to appear, or to use a game caller. Then when the game approaches the hunter's stand, whether in a tree or on the ground, the hunter must be able to quickly and noiselessly release the weapon from its holding straps 12 and 16 with little effort. Thus, with the device 10 of the present invention, the hands and arms are rested instead of holding the weapon 20 in a tiring readiness position.

Figure 2:
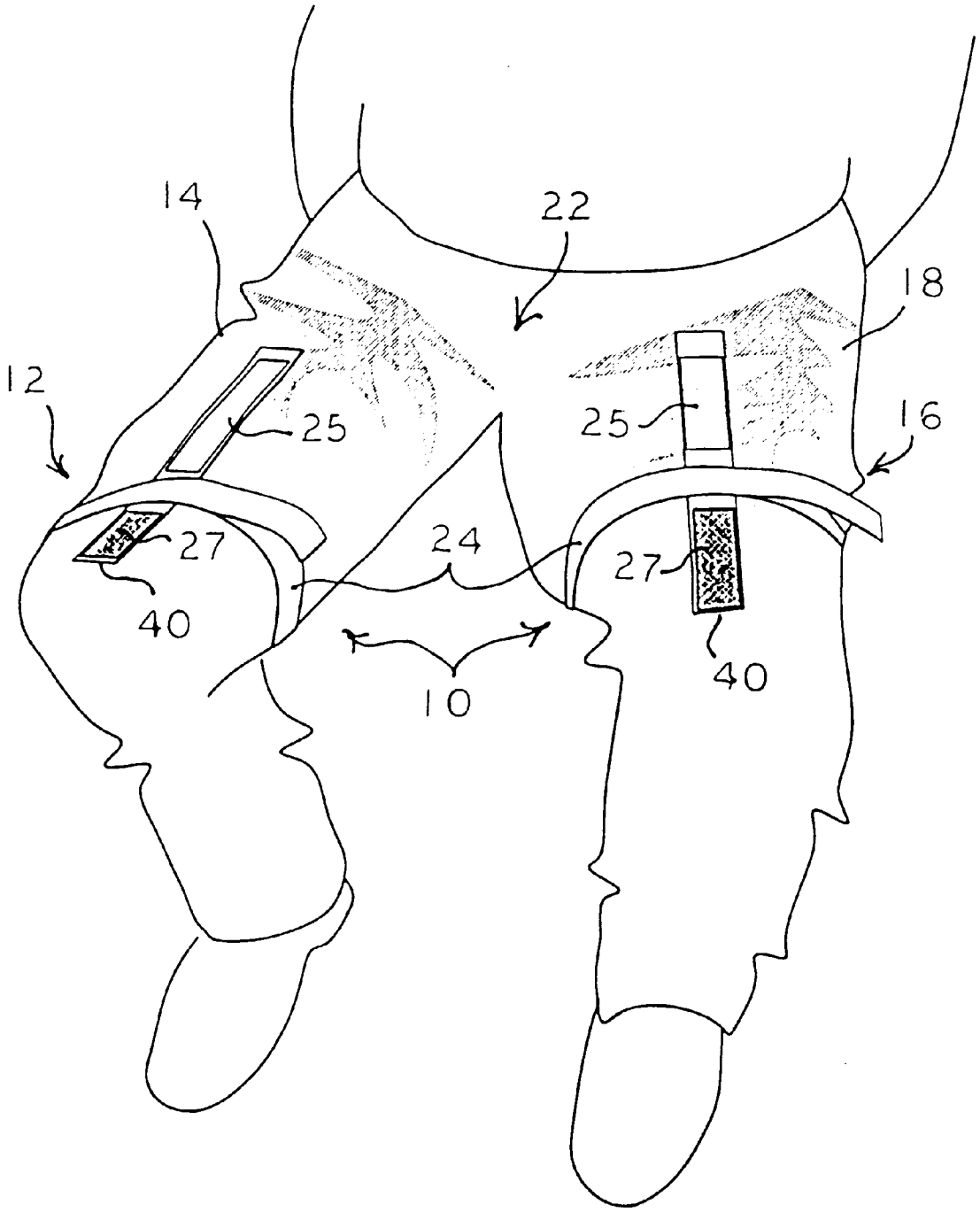
FIG. 2 is a front perspective view of the hunter's legs and the weapon holder straps according to the present invention.

As shown in FIG. 2, each strap 12 or 16 is made from an elongated leg strap 24 of nylon webbing or other suitable flexible, material, with a shorter weapon retainer strap 40, also made of nylon webbing or other suitable flexible, material attached perpendicularly. In a first embodiment, a loop fastener patch 25 is positioned on the upper surface of the longer side of the weapon retainer strap 40 to fasten with the hook fastener patch 27 on the upper surface of the opposite shorter side of the weapon retainer strap 40. It should be noted that, in the embodiment shown in FIGS. 1 and 2, both the fastener patches 25 and 27 are located on the upper surface of weapon retainer strap 40.

Figure 3:
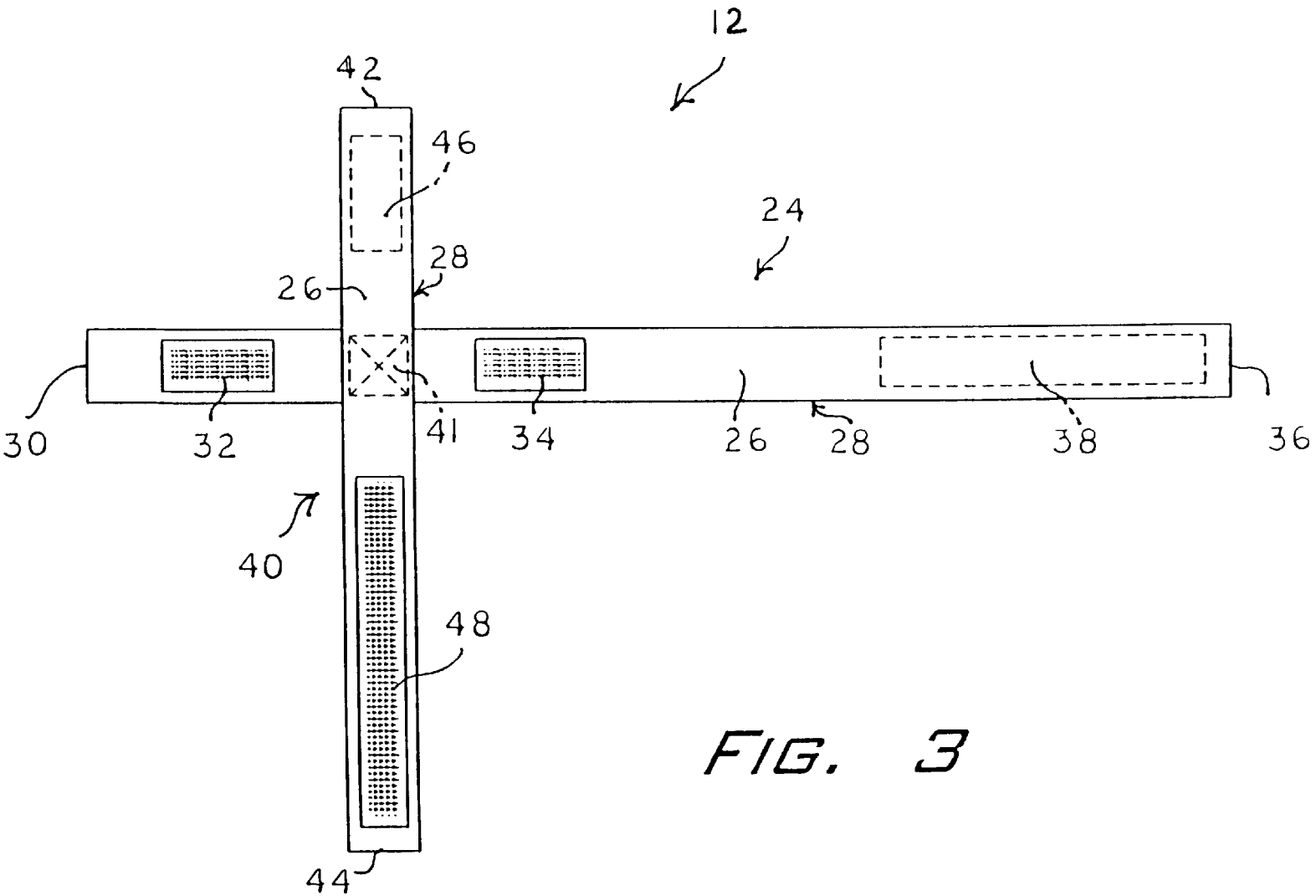
FIG. 3 is a top plan view of a weapon holding strap according to the present invention for the hunter's right leg.
Figure 4:
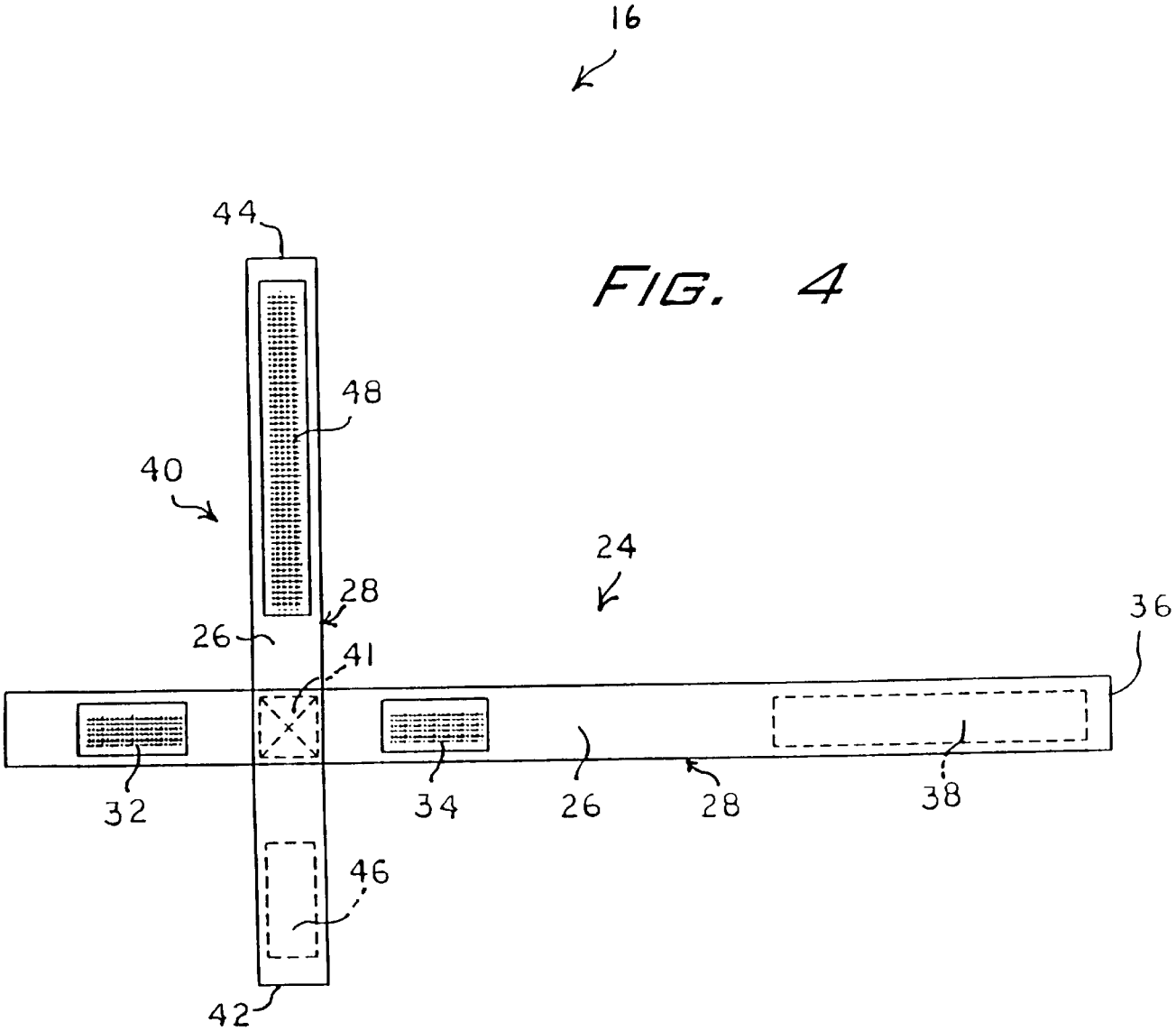
FIG. 4 is a top plan view of a weapon holding strap according to the present invention for the hunter's left leg.

As depicted in FIGS. 3 and 4, the weapons holding device 10 comprises an elongated planar leg strap 24 having an upper surface 26, and a bottom surface 28 (hidden). The leg strap 24 is divided into a first end 30 and a second end 36 by the intersection of the weapon retainer strap 40 with leg strap 24, the first end 30 being shorter in length than the second end 36. Leg strap 24 has first and second hook fastener patches 32 and 34, respectively, on its upper surface 26 proximate the first end 30 on opposite sides of the intersection with weapon retainer strap 40, and an elongated loop fastener patch 38 on its bottom surface 28 proximate its second end 36 for temporarily wrapping around one of the hunter's thighs 14 or 18 by attaching the first end 30 to the second end 36, the elongated loop fastener patch 38 mating with both hook fastener patches 32 and 34.

The weapon retainer strap 40 has an upper surface 26, and a bottom surface 28 (hidden). The strap 40 is divided into a short first end 42 and a long second end 44 by its intersection with leg strap 24. Weapon retainer strap 40 is attached normal, e.g., by a sewn patch 41, to leg strap 24 proximate to leg strap's first end 30 between the first and second hook fastener patches 32, 34. In the second embodiment, as shown in FIGS. 3 and 4, the short first end 42 has a hook fastener patch 46 (shown in shadow) on the bottom surface 28 and a loop fastener patch 48 on the upper surface 26 of the longer second end 44 for wrapping snugly around the weapon. It is to be noted that the structure of the holder strap 12 for the right leg in FIG. 3 is a mirror image of the holder strap 16 for the left leg in FIG. 4. One strap 12 or 16 may be wrapped around the pistol grip end of the firearm 20 and the other strap 12 or 16 may be wrapped around the barrel end of the firearm 20. The device 10 allows the weight of the weapon 20 to be supported safely by the hunter's lap 22 while sitting, leaving the hunter's hands free.

Thus, an efficient and economical weapon holder for a hunter resting a weapon such as a rifle, shotgun or a hunting bow on the lap has been shown when either positioned in a tree or on the ground. It will be noted that it is possible to use quick release buckles, snaps, buttons, or other fasteners in lieu of hook and loop fastener material, but hook and loop fastener material is preferred as it provides quick release, convenience, and it allows for continuous adjustment of the diameter of the loops around the hunter's legs and around the weapon, rather than adjustment in discrete intervals.

It is to be understood that the present invention is not limited to the sole embodiment described above, but encompasses any and all embodiments within the scope of the following claims.

I claim:

1. A weapon holder device for temporarily securing a weapon on a hunter's lap while sitting on the ground or in a tree, comprising a pair of straps for attachment to a hunter's right leg and left leg, respectively, each strap having:

(a) an elongated, planar, flexible leg strap having an upper surface and a bottom surface;

(b) a short, planar, flexible weapon retainer strap, the leg strap being fixedly attached to the weapon retainer strap substantially at a right angle, defining a short end and a long end of the leg strap, and defining a short end and a long end of the weapon retainer strap;

(c) first and second hook and loop fastener patches attached to the upper surface of said leg strap adjacent the short end of said leg strap on opposite sides of the attachment of said weapon retainer strap to said leg strap, and a third, elongated, mating hook and loop fastener patch attached to the bottom surface of said leg strap, whereby said leg strap may be wrapped around a hunter's leg and fastened into a loop with a diameter continuously adjustable to the diameter of the hunter's leg; and (d) weapon retainer strap fastener means for fastening the short end of said weapon retainer strap to the long end of said weapon retainer strap, whereby said weapon retainer strap may be wrapped into a loop around a weapon; said pair of straps defining two releasable and length adjustable loops for encircling and attaching a weapon to a hunter's lap.

2. The weapon holder device according to claim 1, wherein said leg strap fastener means comprises hook and loop fastening material.

3. The weapon holder device according to claim 1, wherein said leg strap fastener means comprises a first strip of hook and loop fastening material attached to the short end of said leg strap and a second strip of hook and loop fastening material attached to the long end of said leg strap.

4. The weapon holder device according to claim 1, wherein said weapon retainer strap fastener means comprises hook and loop fastening material.

5. The weapon holder device according to claim 1, wherein said weapon holder strap fastener means comprises a first strip of hook and loop fastening material attached to the short end of said weapon retainer strap and a second strip of hook and loop fastening material attached to the long end of said weapon retainer strap.

6. The weapon holder device according to claim 1, wherein said leg strap and said weapon retainer strap are made from nylon webbing.

7. The weapon holder device according to claim 1, wherein said weapon retainer strap has an upper surface and a bottom surface, and wherein said weapon retainer strap fastener means comprises first and second mating strips of hook and loop fastening material attached to the upper surface of said weapon retainer strap.

8. The weapon holder device according to claim 1, wherein said weapon retainer strap has an upper surface and a bottom surface, and wherein said weapon retainer strap fastener means comprises a first strip of hook and loop fastening material attached to the upper surface of said weapon retainer strap and a second mating strip of hook and loop fastening material attached to the bottom surface of said weapon retainer strap.

9. The weapon holder device according to claim 1, wherein the structure of the device for one leg is a mirror image of the device for the other leg.

10. A weapon holder device for temporarily securing a weapon on a hunter's lap while sitting on the ground or in a tree, comprising:

(a) an elongated planar nylon strap having an upper surface, a bottom surface, a first end having a short length with first and second hook fastener patches separated on its upper surface proximate the first end, and a second end having a long length with an elongated first loop fastener on its bottom surface proximate its second end for temporarily wrapping around one of the hunter's legs by attaching the first end to the second end; and (b) a short planar nylon strap having an upper surface, a bottom surface, a short first end, and a long second end, said short planar nylon strap attached normal to said elongated planar nylon strap proximate to its first end between the first and second hook fastener patches of the elongated planar nylon strap;

(c) whereby a hunter can secure a weapon across the hunter's lap and readily disengage the hook and loop fastening for immediate use of the weapon.

11. A weapon holder device for temporarily securing a weapon on a hunter's lap while sitting on the ground or in a tree, comprising:

(a) an elongated, planar, flexible leg strap having an upper surface and a bottom surface;

(b) a short, planar, flexible weapon retainer strap having an upper surface and a bottom surface, the leg strap being fixedly attached to the weapon retainer strap substantially at a right angle, defining a short end and a long end of the leg strap, and defining a short end and a long end of the weapon retainer strap;

(c) first and second hook and loop fastener patches attached to the upper surface of said leg strap adjacent the short end of said leg strap on opposite sides of the attachment of said weapon retainer strap to said leg strap, and a third, elongated, mating hook and loop fastener patch attached to the bottom surface of said leg strap, whereby said leg strap may be wrapped around a hunter's leg and fastened into a loop with a diameter continuously adjustable to the diameter of the hunter's leg; and (d) a fourth hook and loop fastener patch attached to the short end of said weapon retainer strap and a fifth hook and loop fastener patch attached to the long end of said weapon retainer strap, whereby said weapon retainer strap may be fastened into a loop around a weapon in order to retain the weapon on a hunter's lap.

12. The weapon holder device according to claim 11, wherein said fourth and fifth hook and loop fastener patches are attached to the upper surface of said weapon retainer strap.

13. The weapon holder device according to claim 11, wherein said fourth hook and loop fastener patch is attached to the bottom surface of the short end of said weapon retainer strap and the fifth hook and loop fastener patch is attached to the upper surface of the long end of said weapon retainer strap.

* * * * *